US008682192B2

(12) United States Patent
Ikebuchi et al.

(10) Patent No.: US 8,682,192 B2
(45) Date of Patent: Mar. 25, 2014

(54) IMAGE FORMING APPARATUS

(75) Inventors: Yutaka Ikebuchi, Kanagawa (JP); Yoshiki Yamaguchi, Kanagawa (JP); Toshihiko Shimokawa, Kanagawa (JP); Kenji Ishii, Kanagawa (JP); Naoki Iwaya, Tokyo (JP); Takahiro Imada, Kanagawa (JP); Tetsuo Tokuda, Kanagawa (JP); Takamasa Hase, Kanagawa (JP); Hiroshi Yoshinaga, Chiba (JP); Ippei Fujimoto, Kanagawa (JP); Masaaki Yoshikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 236 days.

(21) Appl. No.: 13/217,488

(22) Filed: Aug. 25, 2011

(65) Prior Publication Data

US 2012/0051774 A1 Mar. 1, 2012

(30) Foreign Application Priority Data

Aug. 31, 2010 (JP) ..... 2010-193862

(51) Int. Cl.
*G03G 15/20* (2006.01)

(52) U.S. Cl.
USPC ..... 399/67; 399/69

(58) Field of Classification Search
USPC ..... 399/67, 69; 313/579
See application file for complete search history.

(56) References Cited

U.S. PATENT DOCUMENTS 6,628,916 B2 9/2003 Yasui et al.
6,636,709 B2 10/2003 Furukawa et al.
6,778,790 B2 8/2004 Yoshinaga et al.
6,778,804 B2 8/2004 Yoshinaga et al.
6,785,505 B2 8/2004 Yasui et al.
6,813,464 B2 11/2004 Amita et al.
6,881,927 B2 4/2005 Yoshinaga et al.

(Continued)

FOREIGN PATENT DOCUMENTS

JP 2-178528 7/1990
JP 8-202200 8/1996

(Continued)

OTHER PUBLICATIONS

Machine translations of: Nemoto et al., JP2010-220369; Watanabe et al., JP 2007-316410; Yamazaki, JP 8-202200; and Yokono, JP 2009-069371.*

(Continued)

*Primary Examiner* — David Gray
*Assistant Examiner* — Sevan A Aydin
(74) *Attorney, Agent, or Firm* — Oblon, Spivak, McClelland, Maier & Neustadt, L.L.P.

(57) ABSTRACT

An image forming apparatus includes a fixing device including a fixing member; a pressure member to press against the fixing member; and a halogen lamp to heat the fixing member, and a controller to control the halogen lamp. The controller controls an ON duty of the halogen lamp according to a control cycle, and sets the ON duty including two thresholds consisting of a first ON duty and a second ON duty that is larger than the first ON duty. The controller calculates an ON duty of the halogen lamp, judges whether the calculated ON duty is equal to or more than the first duty and less then the second duty, and changes the calculated ON duty when the calculated ON duty is equal to or more than the first duty and less then the second duty.

7 Claims, 11 Drawing Sheets

(56) References Cited

U.S. PATENT DOCUMENTS

| | | | | |
|---|---|---|---|---|
| 6,882,820 | B2 | 4/2005 | Shinshi et al. | |
| 6,892,044 | B2 | 5/2005 | Yasui et al. | |
| 6,937,827 | B2 | 8/2005 | Katoh et al. | |
| 7,022,944 | B2 | 4/2006 | Yoshinaga et al. | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,344,615 | B2 | 3/2008 | Sato et al. | |
| 7,379,698 | B2 | 5/2008 | Yoshinaga | |
| 7,437,111 | B2 | 10/2008 | Yamada et al. | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,546,049 | B2 | 6/2009 | Ehara et al. | |
| 7,570,910 | B2 | 8/2009 | Ishii | |
| 7,702,271 | B2 | 4/2010 | Yamada et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,840,151 | B2 | 11/2010 | Fujimoto | |
| 7,912,392 | B2 | 3/2011 | Yoshinaga et al. | |
| 7,925,177 | B2 | 4/2011 | Ishii et al. | |
| 7,983,582 | B2 | 7/2011 | Hase | |
| 7,983,598 | B2 | 7/2011 | Shinshi et al. | |
| 2006/0068982 | A1 * | 3/2006 | Fechner et al. | 501/70 |
| 2006/0257183 | A1 | 11/2006 | Ehara et al. | |
| 2007/0014600 | A1 | 1/2007 | Ishii et al. | |
| 2008/0063443 | A1 | 3/2008 | Yoshinaga et al. | |
| 2008/0317532 | A1 | 12/2008 | Ehara et al. | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0148205 | A1 | 6/2009 | Seo et al. | |
| 2009/0169232 | A1 | 7/2009 | Kunii et al. | |
| 2009/0245897 | A1 | 10/2009 | Seo et al. | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0239301 | A1 * | 9/2010 | Nemoto et al. | 399/69 |
| 2010/0290822 | A1 | 11/2010 | Hasegawa et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176821 | A1 | 7/2011 | Hase | |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |

FOREIGN PATENT DOCUMENTS

| | | |
|---|---|---|
| JP | 8-248804 | 9/1996 |
| JP | 2002-23548 | 1/2002 |
| JP | 2007-316410 | 12/2007 |
| JP | 2009-69371 | 4/2009 |
| JP | 2010220369 A * | 9/2010 |

OTHER PUBLICATIONS

U.S. Appl. No. 13/048,160, filed Mar. 15, 2011, Yoshiki Yamaguchi, et al.
U.S. Appl. No. 12/964,090, filed Dec. 9, 2010, Naoki Iwaya, et al.
U.S. Appl. No. 13/041,703, filed Mar. 7, 2011, Tadashi Ogawa, et al.
U.S. Appl. No. 13/048,167, filed Mar. 15, 2011, Takahiro Imada, et al.
U.S. Appl. No. 13/016,342, filed Jan. 28, 2011, Tetsuo Tokuda, et al.
U.S. Appl. No. 12/929,496, filed Jan. 28, 2011, Unknown.
U.S. Appl. No. 13/028,597, filed Feb. 16, 2011, Ippei Fujimoto, et al.
U.S. Appl. No. 12/929,930, filed Feb. 25, 2011, Unknown.
U.S. Appl. No. 13/041,739, filed Mar. 7, 2011, Naoki Iwaya, et al.
U.S. Appl. No. 13/042,706, filed Mar. 8, 2011, Tetsuo Tokuda, et al.
U.S. Appl. No. 12/929,915, filed Feb. 24, 2011, Unknown.

* cited by examiner

IMAGE FORMING APPARATUS

CROSS-REFERENCE TO RELATED APPLICATIONS

The present application claims priority from Japanese patent application number 2010-193862, filed on Aug. 31, 2010, the entire contents of which are incorporated by reference herein.

FIELD OF THE INVENTION

The present invention relates to an image forming apparatus including a fixing device with a built-in halogen heater.

DESCRIPTION OF THE RELATED ART

Generally, image forming apparatuses such as electrophotographic printer, copier or the like include a fixing device having a fixing member, such as a fixing roller, to fix with heat and pressure an unfixed toner image onto a recording medium such as a sheet of paper have conventionally been widely known. Such a fixing member is heated by a heat source such as a halogen heater. A pressure member, such as a pressure roller, is provided opposite the fixing member to press against the fixing member. The sheet carrying the unfixed toner image thereon passes through a nip formed between the fixing member and the pressure member, and the toner image is fixed onto the sheet with heat and pressure.

Such a fixing device generally employs a halogen heater as a heat source to heat the fixing member. In the fixing device using the halogen heater, when the halogen heater is repeatedly turned on and off in a very short cycle, a halogen cycle inside the halogen heater terminates in an incomplete state. The halogen cycle is a cyclical thermo-chemical reaction between tungsten vaporized from a filament and halogen gas sealed inside a halogen lamp.

FIG. 13 is a schematic view illustrating the halogen cycle.

As illustrated in FIG. 13, by passing an electric current through a filament 101, the temperature of the filament rises and tungsten 102 is vaporized in a tube 105. As the temperature of the filament 101 rises, halogen gas 103 inside the halogen heater is activated with heat. The vaporized tungsten 102 is combined with activated halogen gas 103 to generate volatile tungsten halide 104.

Thermal convection carries the tungsten halide 104 toward the walls of the tube 105 and returns it to the filament 102. In a high-temperature zone around the filament 102, the tungsten halide 104 thermally decomposes into the tungsten 102 and the halogen gas 103. The tungsten is deposited on the filament and the halogen gas diffuses and is used for a next combination. The above series of reactions constitutes the halogen cycle.

Due to the recent trend toward faster printing speeds and lower thermal capacity of the fixing device, two or more halogen heaters having different light distributions have come to be used. In such a case, the temperature of the filament and the density of the gas inside the halogen heaters can become uneven, with the result that the halogen cycle may take place normally at one place but not at another, which may cause adverse effects such as blackening of the glass tube or premature burnout of the filament.

The problem is a phenomenon called chemical attack. Chemical attack means a state in which the tungsten is not vaporized from the filament and the activated halogen gas reacts directly with the tungsten of the filament to generate tungsten halide, which is volatile. Even though the tungsten is lost from the filament, the tungsten halide cannot be thermally decomposed due to a low filament temperature. Then, the tungsten is not deposited on the filament. As a result, the filament becomes gradually thinner.

FIGS. 14A to 14C are graphs schematically illustrating examples of filament temperature distribution and halogen gas concentration distribution in a conventional halogen heater. In both heater 1 and heater 2, the filament temperature is high enough in the central portion in the longitudinal direction thereof that the tungsten is vaporized. The halogen gas concentration is low as well. However, in edge portions, the filament temperature is low and the tungsten does not vaporize. The halogen gas concentration is high and activated halogen gas activated in the central portion of the heater 1 or 2 accumulates around the edge portions. As a result, chemical attack occurs in the edge portions and the filament becomes thinner and burns out prematurely.

As a measure to cope with the shortened lifetime of the filament, for example, JP-2002-23548-A discloses a method to turn the heater on and off rapidly until the temperature of the glass tube rises to a certain level.

However, a problem with the conventional technology disclosed in JP-2002-23548-A is that the temperature of the glass tube rises due to the closely-disposed halogen heaters even though the temperature of the filament is low, causing the fixing member to overshoot compared to a target temperature for the fixing member because the halogen heater is turned on and off rapidly during a predetermined period, resulting in defective image and a longer standby time.

BRIEF SUMMARY OF THE INVENTION

The present invention aims to solve the aforementioned problems of a conventional fixing device using a halogen lamp as a heat source and provide an optimal image forming apparatus capable of restricting occurrence of defective overshoot and preventing shortened lifetime of the halogen lamp.

The optimal image forming apparatus includes a fixing device, and the fixing device includes a fixing member, a pressure member to press against the fixing member, a halogen lamp to heat the fixing member. The image forming apparatus further includes a controller to control the halogen lamp. The controller controls an ON duty of the halogen lamp according to a control cycle, and sets the ON duty including two thresholds of a first ON duty and a second ON duty that is larger than the first ON duty. The controller calculates an ON duty of the halogen lamp, judges whether the calculated ON duty is equal to or more than the first duty and less then the second duty, and changes the calculated ON duty when the calculated ON duty is equal to or more than the first duty and less then the second duty, to thus control the halogen lamp.

These and other objects, features, and advantages of the present invention will become apparent upon consideration of the following description of the preferred embodiments of the present invention when taken in conjunction with the accompanying drawings.

DETAILED DESCRIPTION OF THE INVENTION

Preferred embodiments of the present invention will now be described with reference to the accompanying drawings.

Figure 1:
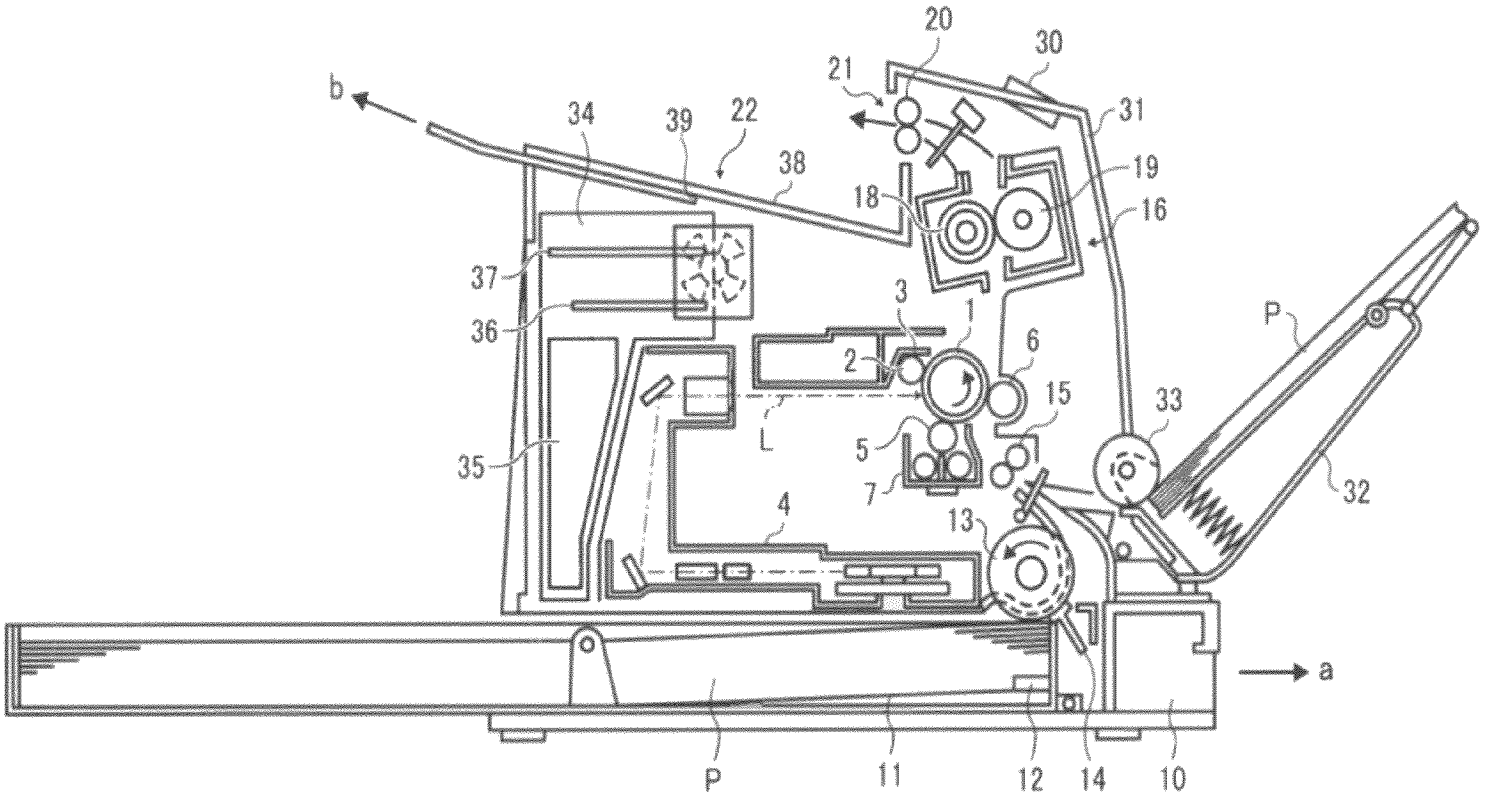
FIG. 1 is a cross-sectional view of a monochrome printer as one example of an image forming apparatus employing a fixing device according to an embodiment of the present invention.

FIG. 1 is a cross-sectional view of a monochrome printer as one example of an image forming apparatus employing a fixing device according to an embodiment of the present invention. The printer as illustrated in FIG. 1 includes, around a photoreceptor 1 rotating in the counterclockwise direction, a charger 2, a cleaner 3, an optical writing unit 4 including a laser optical system and radiating a scanning light L onto the photoreceptor 1, a developing unit 7 including a developing sleeve 5 to render visible a latent image to be carried on the photoreceptor 1 by supplying toner, and a transfer unit 6.

In addition, a sheet feed cassette 10 is disposed in the bottom of the printer and is detachable from the printer in the direction of arrow "a" in the figure. A plurality of sheets P as recording media is stacked inside the sheet feed cassette 10. The sheets P are supported by an inner plate 11 and are pressed against a sheet feed roller 13 by a spring, not shown, via an arm 12. When the sheet feed roller 13 rotates based on an instruction from a controller, not shown, an uppermost sheet inside the sheet feed cassette 10 is conveyed to a pair of registration rollers 15 downstream in the sheet feed direction while a separation pad 14 prevents multiple sheet feed, and is sent to the transfer unit 6 in synchrony with an image carried on the photoreceptor 1.

The sheet on which a toner image has been transferred from the photoreceptor 1 by the transfer unit 6 is further conveyed to a fixing unit 16 and passes through a portion between a heat roller 18 and a pressure roller 19 which is disposed opposite the heat roller 18 with pressure. With such a configuration, the toner image is fixed onto the sheet with heat and pressure applied. Thereafter, the sheet on which an image has been formed is discharged with the image formed surface face down by a sheet discharge roller 20 onto a sheet discharge tray 22 from a sheet outlet 21. A sheet discharge stopper is extendable toward the direction of arrow "b" to accommodate various sheet sizes.

An operation surface is disposed at an upper right surface of the printer body, and a control panel 30 is so provided as to protrude from the upper front surface of the printer. A sheet feed tray 32 is provided to be rotatable about a pin 33. In a case 34 disposed at the left side inside the printer, a power supply unit 35, several printed circuit boards 36 such as an engine driver board, and a controller unit are accommodated. A controller board 37 is also included in the case 34. A cover 38 forming a sheet discharge tray 22 is openable about a hinge 39.

Figure 2:
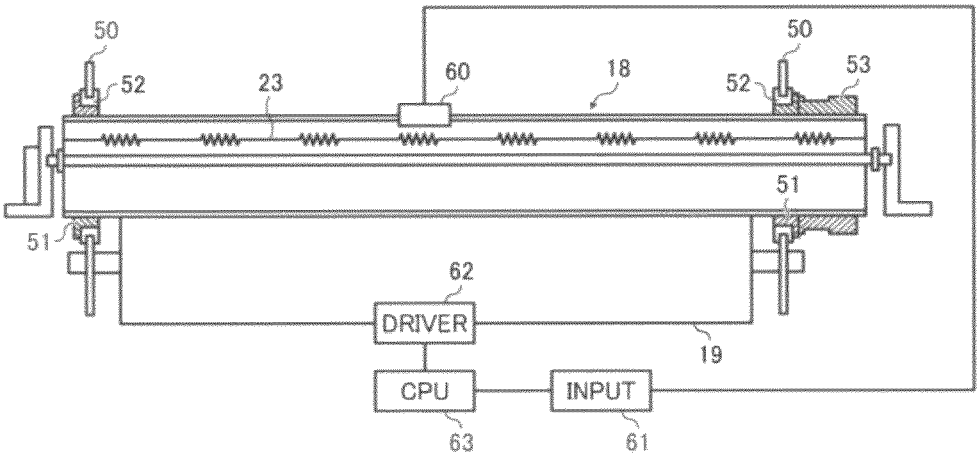
FIG. 2 is a view illustrating a main part of the fixing device.

FIG. 2 is a view illustrating a main part of the fixing unit 16. A cross-sectional view of the fixing roller 18 along its shaft direction is illustrated in FIG. 2. The fixing unit 16 is configured such that the heat fixing roller 18 is pressed against the pressure roller 19 formed of an elastic material such as a silicon rubber with a predetermined pressure by a spring, not shown. The heat fixing roller 18 is attached to fixing side plates 50, 50 via heat insulation bushes 51, 51 and shaft bearings 52, 52. A gear 53 engaging with an edge of the roller 18 is connected with a driving source, not shown, and is driven to rotate.

The fixing roller 18 includes a base member formed of a thin pipe of aluminum or iron. Thickness of the pipe base is approximately 0.3 to 1.0 mm. A surface release layer is formed on an outer surface of the fixing roller 18. The fixing roller 18 includes a built-in halogen heater or lamp 23. The fixing roller 18 contacts a temperature sensor 60 to detect temperature and send a signal based on the detected temperature to a CPU 63 via an input circuit 61. The CPU 63 controls power distribution to the halogen heater 23 via a driver 62 according to the detected temperature of the heat fixing roller 18. Normally, when the power to the apparatus is turned on, electricity is supplied, via the driver 62, to the halogen heater 23, and the temperature of the heat fixing roller 18 drastically increases up to a temperature set for the image fixation. It should be noted that even though the heating member is formed not of a roller but a belt, the same control is performed.

Figure 3:
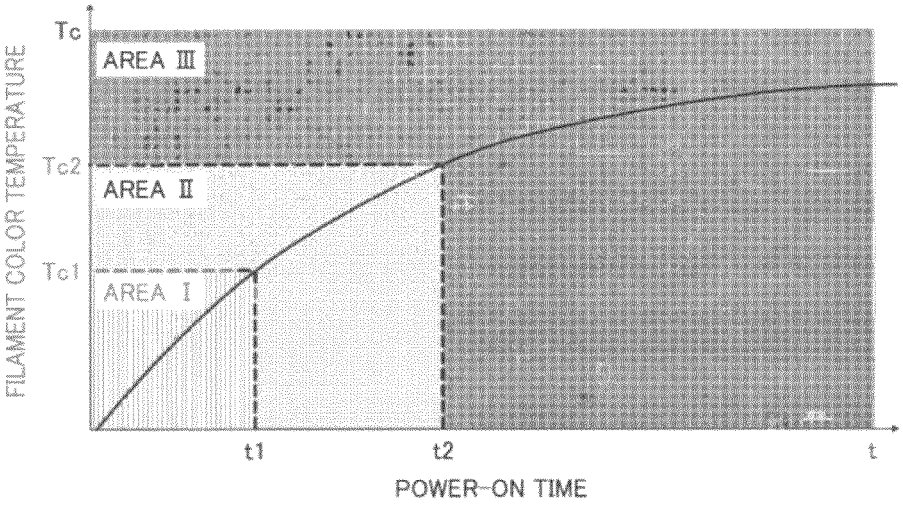
FIG. 3 is a graph showing a relation between activation period of the halogen heater and the color temperature of the filament.

FIG. 3 is a graph illustrating a relation between the length of time the heater is turned on (the "time period") and a color temperature of a filament. The color temperature of the halogen heater increases with the length of time the heater is on, and reaches saturation when a predetermined time has elapsed after the power to the heater has been turned on. Chemical attack tends to occur when the color temperature is greater than Tc1 and less than Tc2, that is, in Area II. Accordingly, when the heater is activated from a state in which the filament has been sufficiently cooled down, at a time when the power is on for a time period of more than t1, chemical attack begins to occur. However, when power continues for more than t2 as in Area III, chemical attack does not occur. Further, when the power is turned on for a time period of less than t1 (as in Area I), neither halogen cycle nor chemical attack occur.

Specifically, as illustrated in Table 1 below, the halogen lamp having a filament diameter of from 100 to 200 μm requires approximately 20 ms of power-on time so that the filament color temperature reaches 1,000K (Kelvin), and approximately 80 ms of power-on time so that the filament color temperature reaches 2,000K (Kelvin). The halogen cycle does not occur inside the halogen lamp when the power-on time is less than 20 ms, and the halogen cycle begins to occur when the power-on time exceeds 20 ms in which the filament temperature exceeds 1,000K. In such a condition, when the power-on time is less than 80 ms, the halogen cycle is not sufficient and chemical attack occurs. By contrast, when the power-on time is more than 80 ms, the chemical attack does not occur and the lifetime of the halogen lamp is preserved thanks to the occurrence of the normal halogen cycle.

TABLE 1

| Relation between the color temperature and the power-on time of a heater using a filament with a diameter of from 100 to 200 μm | |
|---|---|
| Filament Color Temperature | Power-on Time |
| 1,000 K (Tc1) | 20 ms (t1) |
| 2,000 K (Tc2) | 80 ms (t2) |

Figure 4:
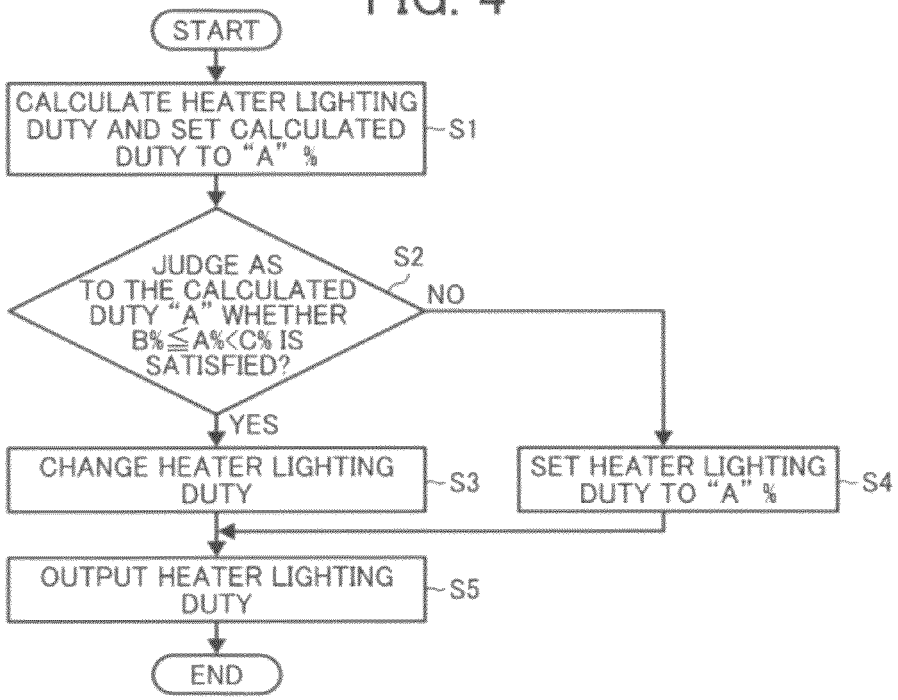
FIG. 4 is a flowchart illustrating steps in a process of halogen heater control according to a first embodiment.

FIG. 4 is a flowchart illustrating a first embodiment of controlling the halogen heater. As illustrated in FIG. 4, first, a heater lighting duty or ON duty is calculated from the history of the temperatures of the fixing roller detected by the temperature sensor 60 (S1). The calculated ON duty here is set to "A" %. Next, it is judged whether the calculated duty "A" satisfies a relation B %≤A %<C % (S2). If, in S2, the duty "A" satisfies the relation B %≤A %<C %, the process proceeds to S3 in which the heater ON duty is changed, and the heater ON duty is output so that the heater lighting control is performed in S5. By contrast, if, in S2, it is judged that the calculated duty "A" does not satisfy the relation B %≤A %≤C %, that is, the calculated duty "A" is judged to be less than "B" or more than "C", the process proceeds to S4 and the duty "A" is set and the heater lighting control is performed in S5.

The duties B and C are set as described below so that, when the calculated ON duty "A" % is included in Area II in FIG. 3, i.e., the area in which chemical attack tends to occur, the ON duty is changed, chemical attack is prevented, and the lifetime of the heater is prevented from being shortened.

Figure 5:
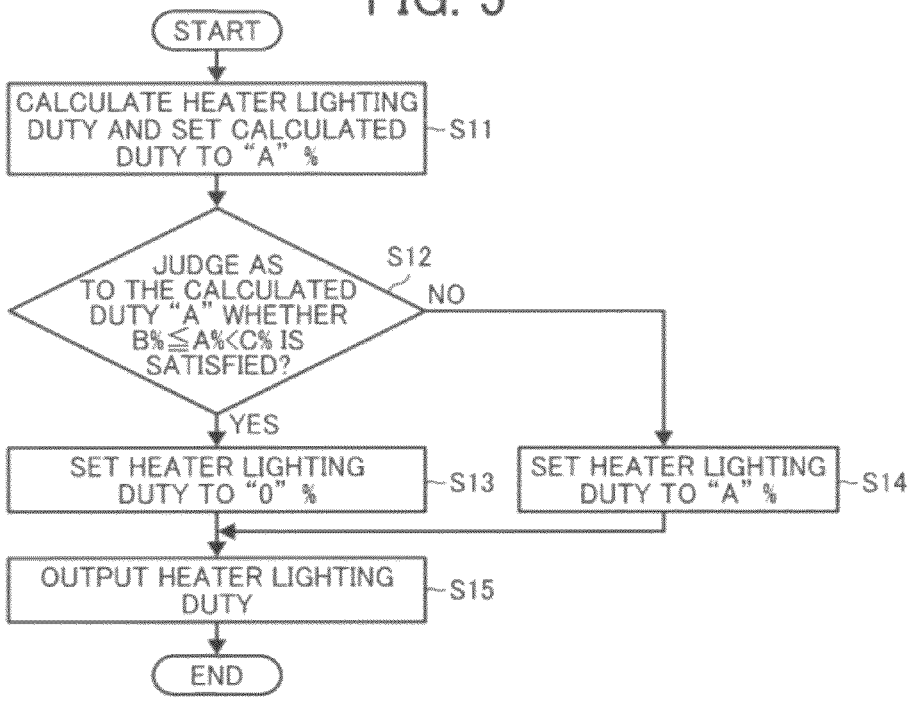
FIG. 5 is a flowchart illustrating steps in a process of halogen heater control according to a second embodiment.

FIG. 5 is a flowchart illustrating a second embodiment of controlling the halogen heater. First, a heater ON duty "A" is calculated from the history of the temperatures of the fixing roller detected by the temperature sensor 60 using PID control (S11). Next, it is determined whether the calculated duty "A" satisfies the relation B %≤A %<C % (S12). If, in S12, the duty "A" satisfies the relation B %≤A %<C %, the process proceeds to S13 in which the heater ON duty is set to 0 (zero) %. Specifically, the heater is not lighted. By contrast, if it is judged that the duty "A" is less than "B" or more than "C" in S12, the process proceeds to S14 in which the heater ON duty is set to "A" to be processed to output the heater ON duty in S15, thereby performing the heater lighting control.

The duties B and C are set as described below so that, when the calculated ON duty "A" % is included in Area II in FIG. 3, i.e., the area in which chemical attack tends to occur, the heater is not turned on in the second embodiment, whereby the abnormal halogen cycle is prevented and the lifetime of the heater is prevented from being shortened.

Figure 6:
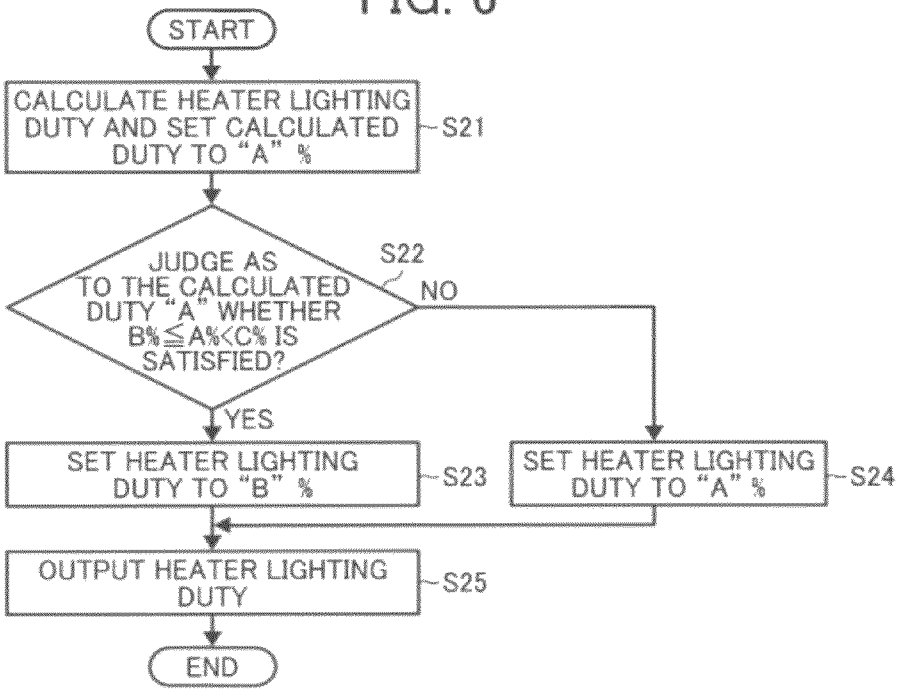
FIG. 6 is a flowchart illustrating steps in a process of halogen heater control according to a third embodiment.

FIG. 6 is a flowchart illustrating a third embodiment of controlling the halogen heater. In the third embodiment, first, a heater ON duty "A" is calculated from the history of the temperatures of the fixing roller detected by the temperature sensor 60 using PID control (S21). Next, it is judged whether the calculated duty "A" satisfies the relation B %≤A %<C % (S22). In S22, if the duty "A" is determined to be equal to or more than "B" and less than "C", the process proceeds to S23 in which the heater ON duty is set to "B"%. By contrast, if, in S22, it is judged that the duty "A" is less than B or more than C, the process proceeds to S24 and the ON duty is set to "A"% as is and the ON duty "A" is output in S25.

The duties B and C are set as described below so that, when the calculated ON duty "A" % is included in Area II, i.e., the area in which chemical attack tends to occur, the ON duty is changed to the maximum ON duty so that the halogen cycle does not occur in the third embodiment, whereby the abnormal halogen cycle is securely eliminated to prevent the lifetime of the heater from decreasing and the temperature decrease due to the power-off of the halogen lamp can be prevented.

Figure 7:
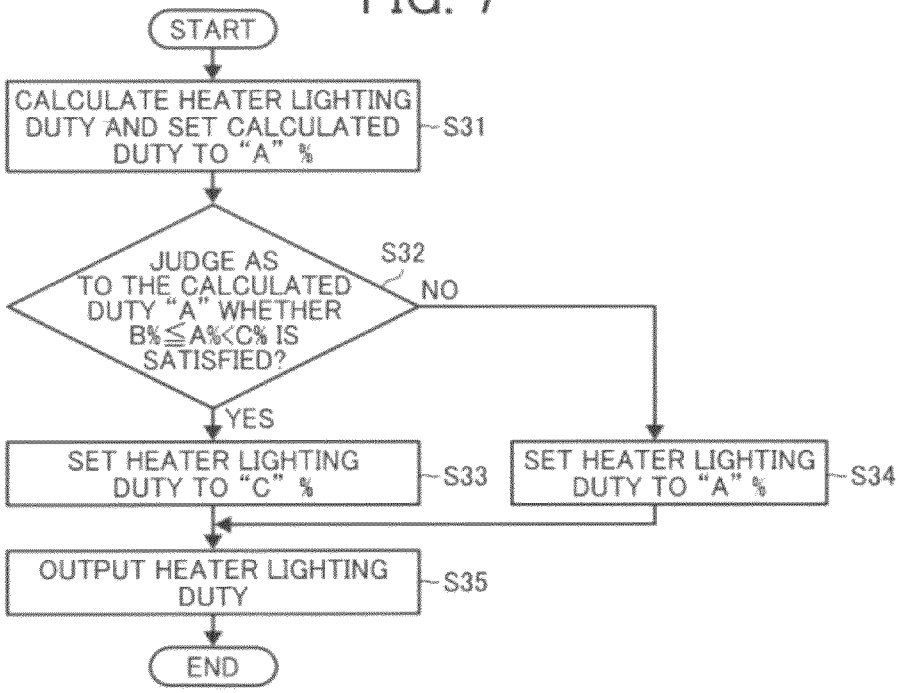
FIG. 7 is a flowchart illustrating steps in a process of halogen heater control according to a fourth embodiment.

FIG. 7 is a flowchart illustrating a fourth embodiment of controlling the halogen heater. In the fourth embodiment, first, a heater ON duty "A" is calculated from the history of the temperatures of the fixing roller detected by the temperature sensor 60 using PID control (S31). Next, it is judged whether the calculated duty "A" satisfies the relation B %≤A %<C % (S32). In S32, if the duty "A" is equal to or more than "B" and less than "C", the process proceeds to S33 and the heater ON duty is set to "C"%. By contrast, if in S32 it is judged that the duty "A" is less than "B" or more than "C", the process proceeds to S34 in which the duty is set to "A", and an output process is performed with the duty "A" to thus perform the heater lighting control.

The duties B and C are set as described below so that, when the calculated ON duty "A" % is included in Area II, i.e., the area in which the chemical attack tends to occur, the ON duty is changed to a minimum ON duty and the halogen cycle is performed normally, whereby the abnormal halogen cycle is securely eliminated to prevent the lifetime of the heater from decreasing and the temperature decrease due to the power-off of the halogen lamp can be prevented.

Here, the duties "B" and "C" will now be described. As described above, FIG. 3 is a graph showing a relation between the activation period of the halogen heater and the color temperature of the filament. The color temperature Tc1 in this graph shows a maximum color temperature in which the filament in the halogen lamp generates heat but the substance of the filament related to the halogen cycle does not vaporize. The substance of the filament related to the halogen cycle denotes tungsten if the main component of the filament is tungsten. t1 in the figure shows the power-on time of the halogen lamp in which the color temperature of the filament becomes Tc1. Accordingly, allowing the heater not to be powered on more than the duty "B" in which the power-on time of the halogen lamp is t1, the lifetime decrease of the halogen heater due to the abnormal halogen cycle may be prevented.

In addition, the color temperature Tc2 in FIG. 3 is a minimum color temperature in which the filament inside the halogen lamp generates enough heat and the halogen cycle is performed normally. t2 in the figure is the power-on time of the halogen lamp in which the color temperature of the filament becomes Tc2. Accordingly, the duty "C" is the time added with an allowance of t3 in addition to the power-on time t2 of the halogen lamp and the halogen heater is to be powered on with the duty "C" or more, so that the lifetime decrease due to the abnormal halogen cycle can be prevented. FIG. 3 does not show t3. The allowance time t3 may be 20 ms or so.

As is shown with reference to Table 1, the duty "B" is the duty in which the color temperature of the filament becomes approximately 1,000K (Kelvin). In a case of the halogen lamp including a filament with a diameter of from 100 to 200 μm, the duty "B" is approximately 20 ms. (For example, when the heater control cycle is 500 ms, the duty becomes 4%.) Similarly, the duty "C" is the duty in which the color temperature of the filament becomes approximately 2,000K (Kelvin). In a case of the halogen lamp including a filament with a diameter of from 100 to 200 μm, the duty "B" is approximately 80 to 100 ms. (For example, when the heater control cycle is 500 ms, the duty becomes 16%.)

Figure 8A:
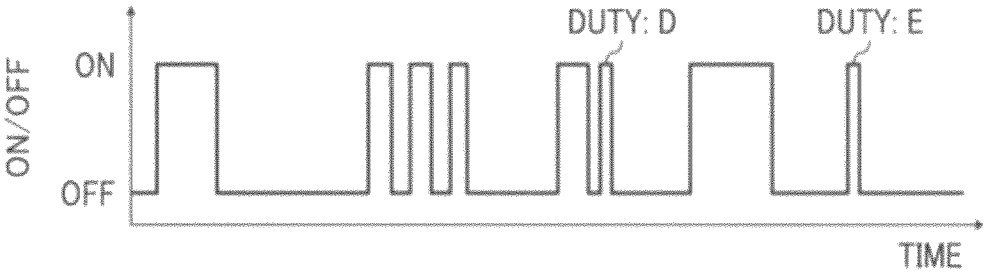
FIGS. 8A and 8B are a chart and a graph, respectively, illustrating an example of halogen heater control.
Figure 8B:
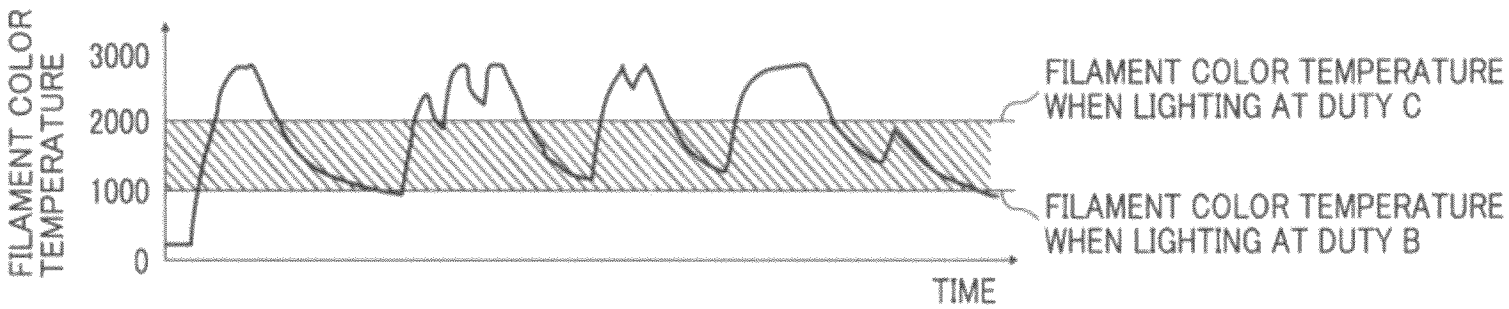

FIGS. 8A and 8B show an example of controlling the halogen heater. FIG. 8A is a chart illustrating lighting states of a heater, and FIG. 8B is a graph illustrating a color temperature of the filament corresponding to FIG. 8A. As illustrated in FIG. 8B, a range between the color temperature of the filament when the heater is lighted at the duty "B" and the color temperature of the filament when the heater is lighted at the duty "C" is shaded with diagonal lines. This shaded portion is the range of the color temperature in which chemical attack tends to occur. Accordingly, when the heater is lighted, the color temperature of the filament by certain ON duty should preferably be outside the above shaded portion. (If the color temperature of the filament does not exceed 2,000K when the heater is turned on, an adverse effect due to the occurrence of chemical attack arises.)

In FIG. 8A, the values of the duty "D" and the duty "E" are the same, and the both are more than the duty "B" and less than the duty "C". Here, in the case of duty "D", the time elapsed from the previous lighting is short and the temperature of the filament is sufficiently high from the previous lighting. When the lighting at the duty "D" starts, the temperature of the filament remains high. Then, the abnormal halogen cycle does not occur even though the lighting is performed with more than the duty "B" and less than the duty "C". On the other hand, in the case of duty "E", time elapsed from the previous lighting is long and the temperature of the filament decreases. The temperature of the filament does not sufficiently rise by the lighting of the duty "E", and there is a possibility that chemical attack occurs.

Figure 9:
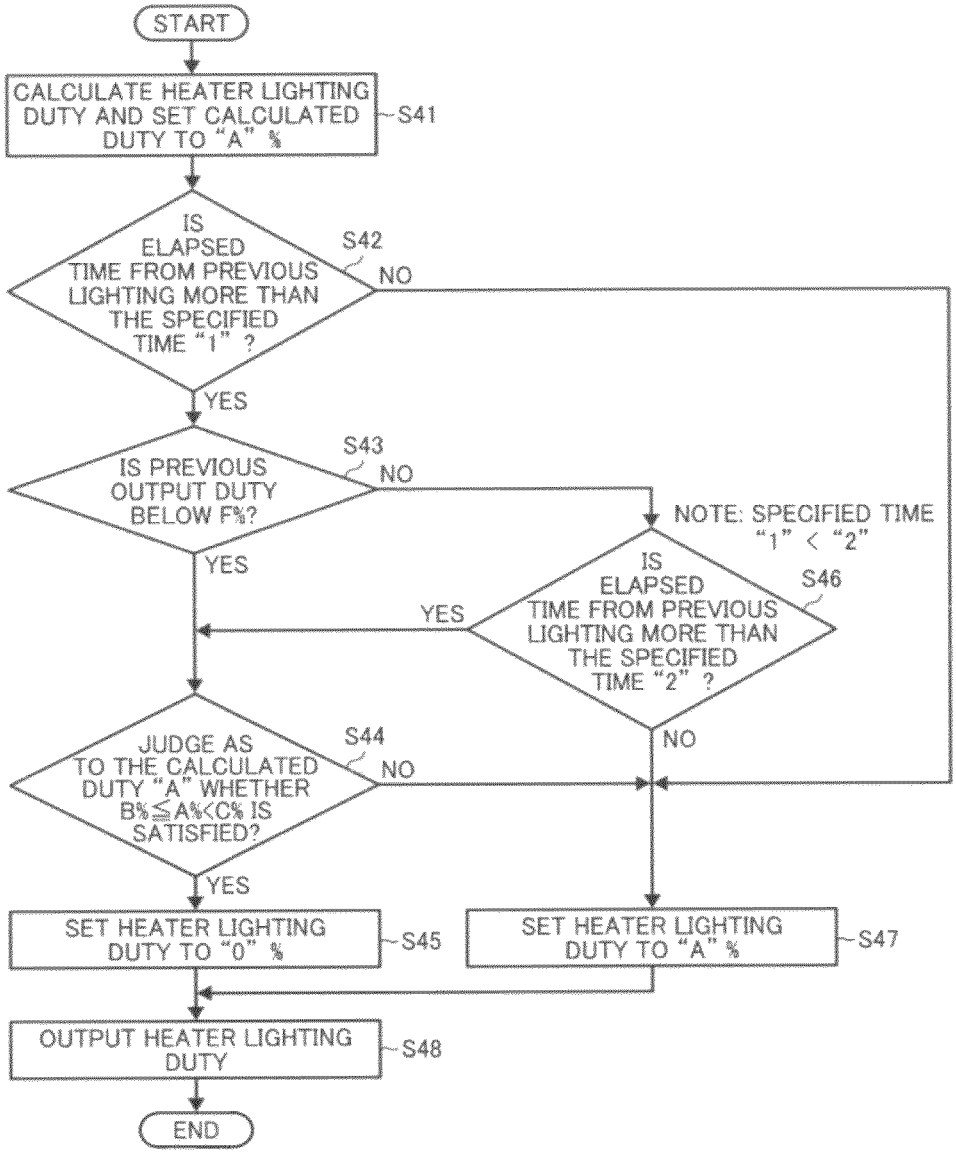
FIG. 9 is a flowchart illustrating steps in a process of halogen heater control according to a fifth embodiment.

In such a case, by applying the control as illustrated in FIG. 9 (a fifth embodiment), the above duty "E" can be controlled or changed so that the actual output becomes outside the shaded range in FIG. 8B, thereby preventing occurrence of chemical attack and the decrease of the lifetime of the filament.

FIG. 9 is a flowchart illustrating a fifth embodiment of controlling the halogen heater.

As illustrated in this flowchart, first, a heater ON duty "A" is calculated from the history of the temperatures of the fixing roller detected by the temperature sensor 60 using PID control or the like (S41). Then, it is judged whether the time elapsed from the previous lighting is more than the specified time "1" (S42). Here, when the time elapsed from the previous lighting is less than the specified time "1", the process proceeds to S47, the actual output duty is set to "A", and the output process is performed in S48, thereby performing the heater lighting control.

When the time elapsed from the previous lighting is more than the specified time "1" in S42, it is judged whether the previous output duty is below "F"% or not (S43). When the previous output duty is more than "F"%, it is deemed that the temperature of the filament in the previous lighting rose sufficiently and the process proceeds to S46, where it is judged whether the time elapsed more than the specified time "2". It is noted that the specified time "1" is shorter than the specified time "2". In S46, if the time elapsed from the previous lighting is shorter than the specified time "2", it is deemed that the temperature of the filament remains high, the process proceeds to S47 in which the actual output duty is set to "A", and output processing is performed in S48, thereby performing the heater lighting control.

In either case in which the previous ON duty is below "F"% in S43 or in which the elapsed time from the previous lighting is more than the specified time "2" in S46, the process proceeds to S44 and it is judged whether the calculated duty "A" in S41 satisfies the relation B %≤A %<C %. If the calculated duty "A" does not satisfy the relation B %≤A %<C %, the process proceeds to S47 in which the actual output duty is set to "A"%, and the set heater ON duty is output in S48 and the heater is lighting-controlled.

By contrast, if in S44 it is judged that the duty "A" is more than "B" and less than "C", the process proceeds to S45 and the actual output duty is set to "0"%, and the heater ON duty output is performed in S48 and the heater is not turned on. In the present embodiment, the heater ON duty is changed to "0"% in S45 as in the second embodiment; however, the heater ON duty may be changed to "B"% as in the third embodiment (see FIG. 11) and to "C"% as in the fourth embodiment (see FIG. 12).

As described above, in the fifth embodiment, the elapsed time from the previous lighting and the duty in the previous lighting are added to the control of the heater ON duty for finer control, thereby eliminating the abnormal halogen cycle and preventing decrease in the fixing temperature.

Figure 10A:
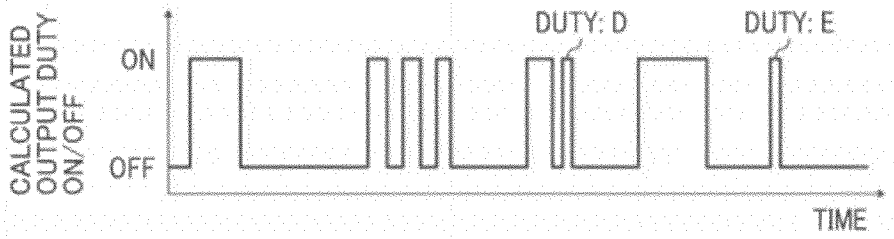
FIGS. 10A to 10C are charts and a graph illustrating an example in which the fifth example is applied to the heater control as illustrated in FIGS. 8A to 8C.
Figure 10B:
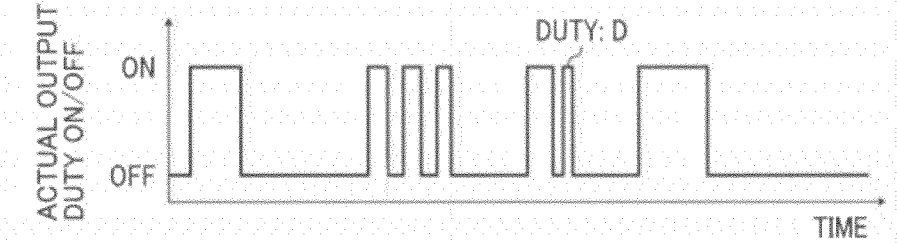
Figure 10C:
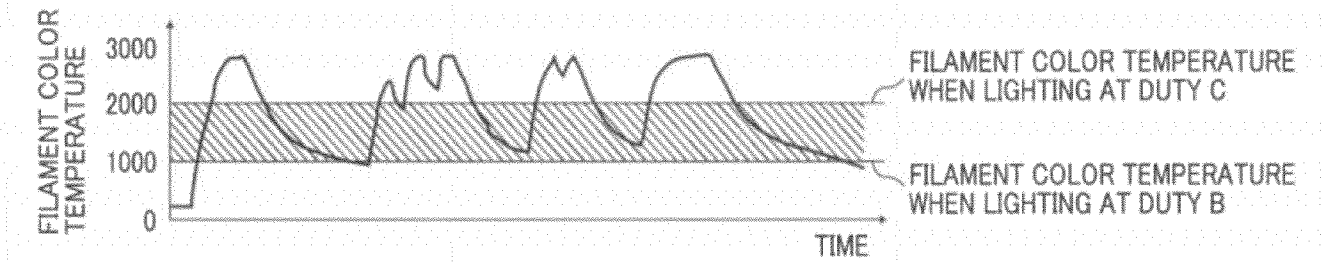

FIGS. 10A to 10C show a case in which the heater ON duty as illustrated in FIG. 8A is adapted to the fifth embodiment as described above. FIG. 10A is a chart illustrating calculated output duties. FIG. 10B is a chart illustrating actual output duties after the output control has been applied. FIG. 10C is a graph illustrating the filament color temperature after the control.

Referring to the flowchart in FIG. 9, the duty "D" is output shortly after the previous lighting and is judged as NO in S42, and then the process proceeds to S47 in which the duty is set to the calculated duty "A"% (herein, the same duty "D"), and is lighting-controlled as is. By contrast, the duty "E" is output with a longer time elapsed from the previous lighting, is judged as YES in S42, and further is judged as YES in S44. That is, the duty "E" is judged to be more than "B" and less than "C" to thus proceed to S45 and the actual ON duty is changed to "0" % so that the heater is not lighted, thereby preventing occurrence of chemical attack and decrease of the lifetime of the filament.

Figure 11:
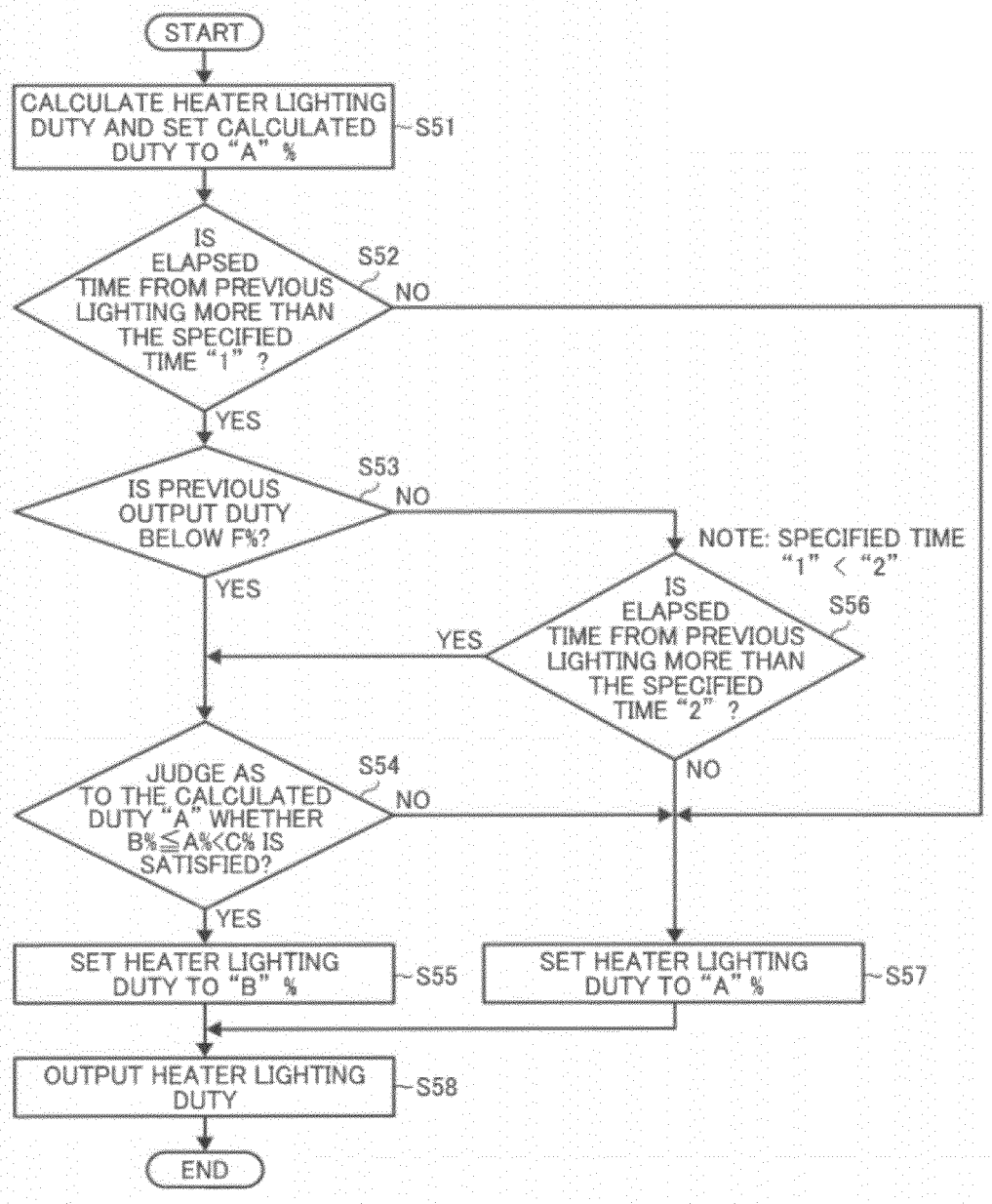
FIG. 11 is a flowchart illustrating steps in a process of halogen heater control according to a sixth embodiment.
Figure 12:
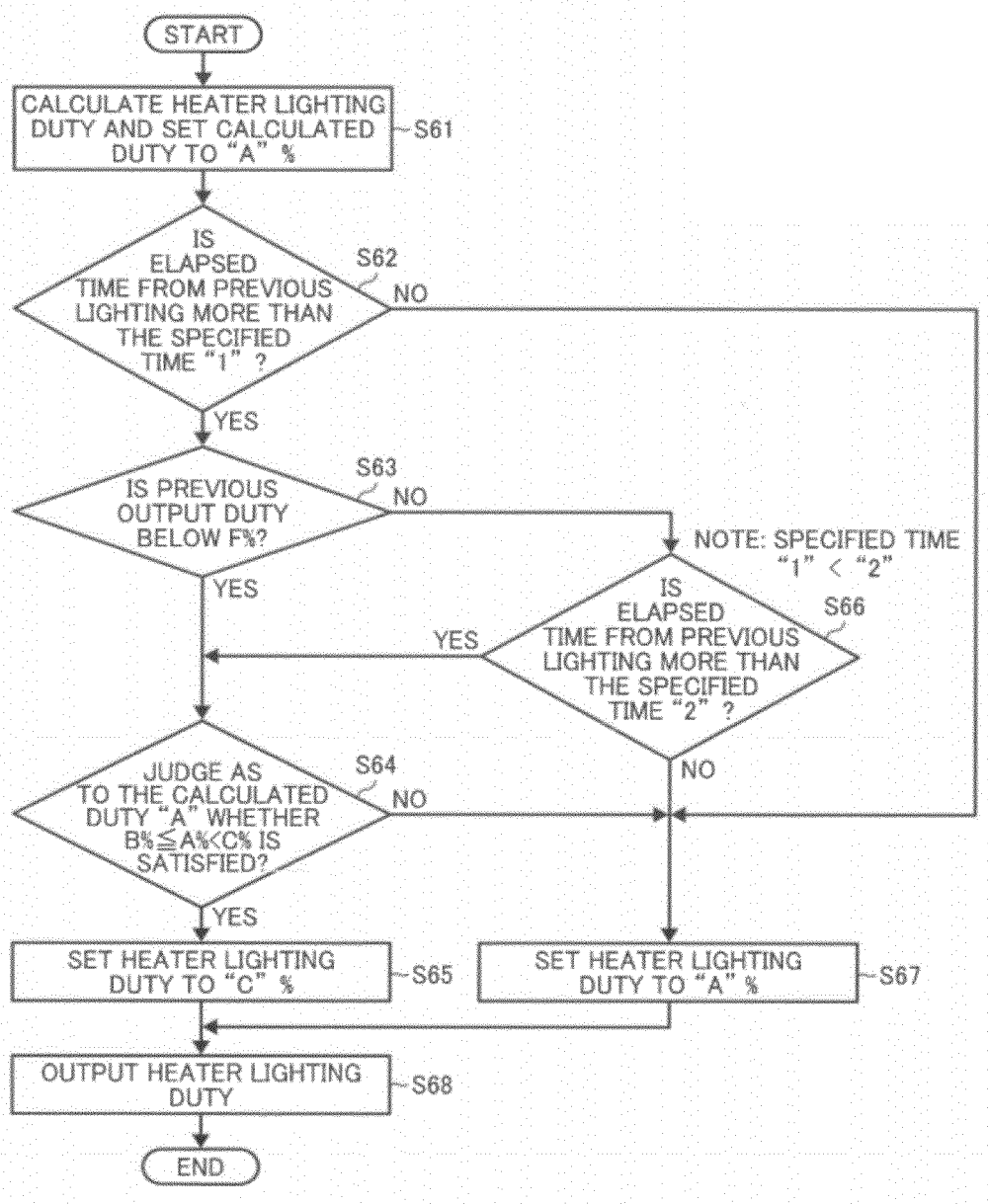
FIG. 12 is a flowchart illustrating steps in a process of halogen heater control according to a seventh embodiment.
Figure 13:
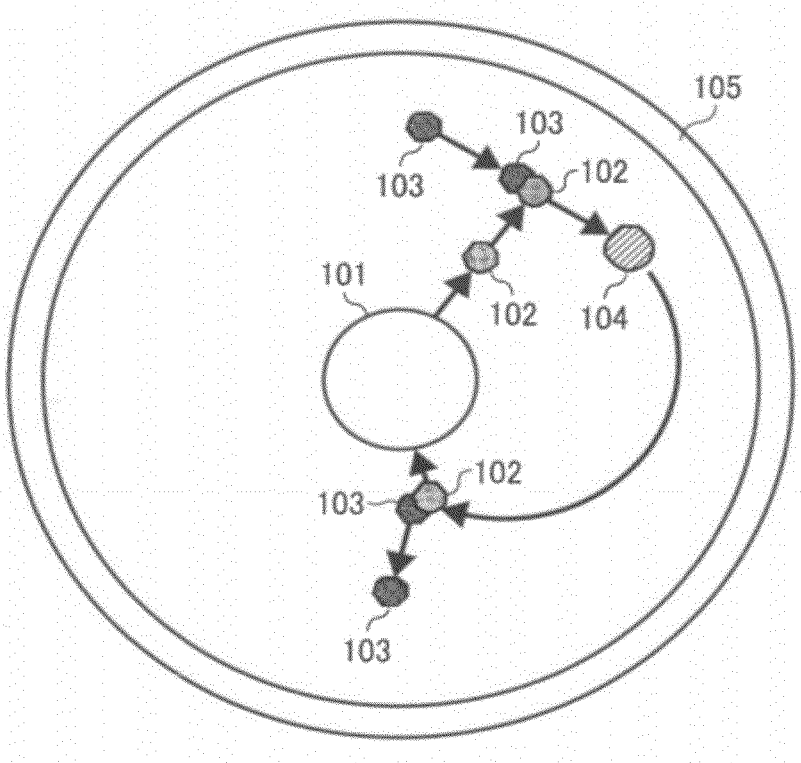
FIG. 13 PRIOR ART
FIG. 13 is a schematic illustration of a halogen cycle.
Figure 14A:
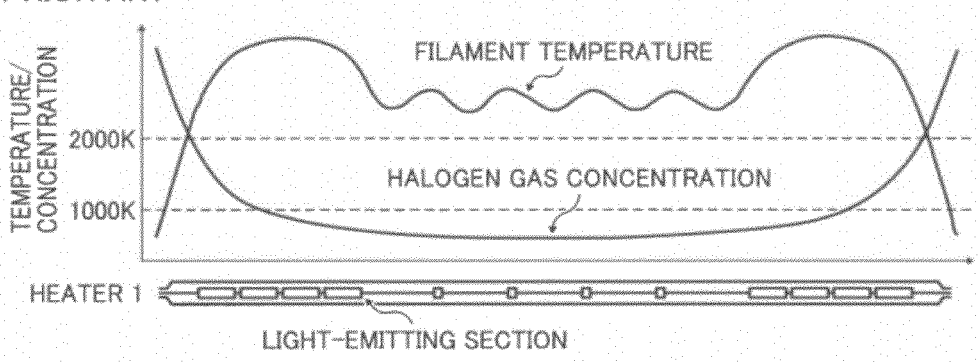
FIG. 14A PRIOR ART
FIGS. 14A to 14C are graphs schematically illustrating examples of filament temperature distribution and halogen gas concentration distribution in a conventional halogen heater.
Figure 14B:
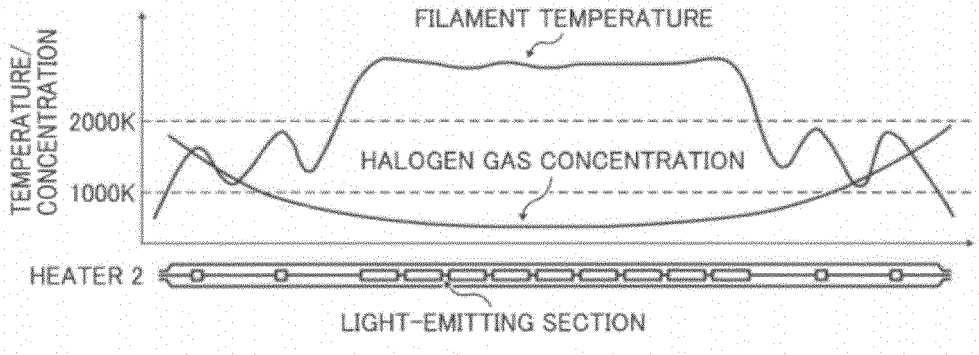
FIG. 14B PRIOR ART
Figure 14C:
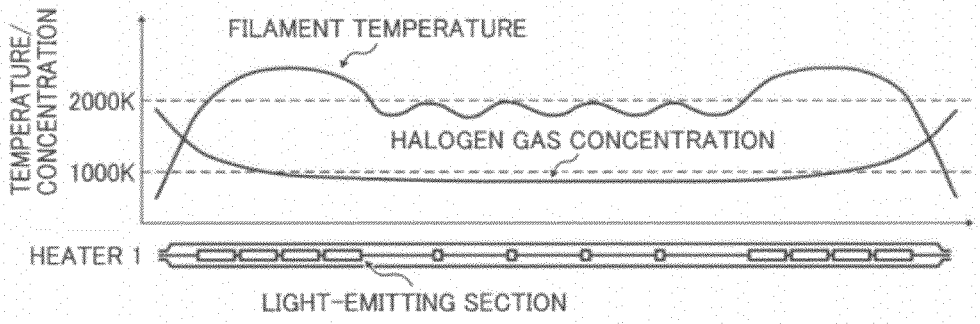
FIG. 14C PRIOR ART

FIGS. 11 and 12 are flowcharts illustrating a sixth and seventh embodiment, respectively. Differences from the fifth embodiment reside in S55 and S65, each corresponding to S45 of FIG. 9.

In the sixth embodiment, the actual output duty is changed to "B"% in S55 and the heater lighting control is performed. Because the actual output duty is controlled and changed to the maximum ON duty so that the halogen cycle does not occur, the abnormal halogen cycle is securely prevented from occurring, and the temperature decrease due to the power-off of the halogen lamp may be reduced.

In the seventh embodiment, the actual output duty is changed to "C"% in S55 and the heater lighting control is performed. Because the actual output duty is controlled and changed to the minimum ON duty so that the normal halogen cycle is performed, the abnormal halogen cycle is securely prevented from occurring, the decrease in the lifetime of the heater is prevented, and the temperature decrease due to the power-off of the halogen lamp may be reduced.

In the case in which the sixth or the seventh embodiment is applied to the heater ON duty as illustrated in FIG. 8A, the abnormal halogen cycle is prevented and the heater lifetime loss is prevented similarly to the case of the fifth embodiment. Useless decrease in the fixing temperature is also prevented due to finer control.

It is noted that the present invention is not limited to the embodiments described above. For example, the fixing method is not limited to the heat roll method and may be adapted to the belt fixing method. Arrangements of the halogen lamp or heater and materials for the filament are selectable. In addition, the present invention may be applied to a structure using a plurality of heaters with different layouts. Control cycles of the halogen heater are also selectable. Not limited to the monochrome printers, the present invention may be applied various types of printers and apparatuses including multicolor machines and full-color machines, each of which may be a copier, a facsimile machine, or a multi-functional apparatus.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a fixing device comprising a fixing member, a pressure member to press against the fixing member, and a halogen lamp to heat the fixing member; and a controller to control the halogen lamp, the controller being configured to:

set an ON duty of the halogen lamp according to a control cycle, the ON duty including two thresholds defined based on a filament color temperature of the halogen lamp, wherein the two thresholds respectively correspond to a first ON duty and a second ON duty larger than the first ON duty;

calculate a calculated ON duty of the halogen lamp;

judge whether the calculated ON duty is equal to or more than the first ON duty and less than the second ON duty; and change the calculated ON duty when the calculated ON duty is equal to or more than the first ON duty and less then the second ON duty.

2. The image forming apparatus as claimed in claim 1, wherein the controller does not light the halogen lamp when the calculated ON duty of the halogen lamp is equal to or more than the first ON duty and less than the second ON duty.

3. The image forming apparatus as claimed in claim 1, wherein the controller controls the halogen lamp to light with less than the first duty when the calculated ON duty of the halogen lamp is equal to or more than the first ON duty and less than the second ON duty.

4. The image forming apparatus as claimed in claim 1, wherein the controller lights the halogen lamp with more than the second ON duty when the calculated ON duty of the halogen lamp is equal to or more than the first ON duty and less than the second ON duty.

5. The image forming apparatus as claimed in claim 1, wherein the first ON duty is set to the maximum duty in which a filament of the halogen lamp generates heat without vaporizing a substance of the filament related to a halogen cycle.

6. The image forming apparatus as claimed in claim 1, wherein the second ON duty is set to a duty obtained by adding a predetermined allowance to the minimum lighting time in which a halogen cycle inside the halogen lamp is normally performed.

7. The image forming apparatus as claimed in claim 1, wherein the controller controls the halogen lamp based on elapsed time from a previous lighting of the halogen lamp and an ON duty of the previous lighting.

* * * * *